US008932111B2

(12) United States Patent
Tessmar et al.

(10) Patent No.: US 8,932,111 B2
(45) Date of Patent: Jan. 13, 2015

(54) APPARATUS FOR ALTERING A SURFACE OF A BOWLING BALL

(76) Inventors: Lori Tessmar, Washington Township, MI (US); Louis Marquez, Chesterfield, MI (US); Robert Learn, Jr., Chesterfield, MI (US)

( * ) Notice: Subject to any disclaimer, the term of this patent is extended or adjusted under 35 U.S.C. 154(b) by 268 days.

(21) Appl. No.: 13/531,913

(22) Filed: Jun. 25, 2012

(65) Prior Publication Data

US 2013/0005223 A1 Jan. 3, 2013

Related U.S. Application Data

(60) Provisional application No. 61/502,088, filed on Jun. 28, 2011.

(51) Int. Cl.

| | |
|---|---|
| ***B24B 11/00*** | (2006.01) |
| ***B24B 11/02*** | (2006.01) |
| ***B24B 29/04*** | (2006.01) |
| ***B24D 11/00*** | (2006.01) |
| ***B24D 15/04*** | (2006.01) |

(52) U.S. Cl.

CPC ..... *B24B 11/02* (2013.01); *B24B 29/04* (2013.01); *B24D 11/00* (2013.01); *B24D 15/04* (2013.01)

USPC ..... 451/50; 451/364

(58) Field of Classification Search

CPC ..... B24B 11/06; B24B 11/10; B24B 11/02; B24B 11/08; A63B 45/00

USPC ..... 451/50, 364

See application file for complete search history.

(56) References Cited

U.S. PATENT DOCUMENTS

| | | | | |
|---|---|---|---|---|
| 1,694,900 | A * | 12/1928 | Zimmerling | 451/259 |
| 2,405,344 | A * | 8/1946 | Cloutier | 451/50 |
| 2,420,988 | A * | 5/1947 | Tholen | 15/97.1 |
| 2,438,773 | A * | 3/1948 | Warlick | 451/317 |
| 2,493,681 | A * | 1/1950 | Mayer et al. | 134/6 |
| 2,980,935 | A * | 4/1961 | Bogard et al. | 134/6 |
| 3,281,883 | A * | 11/1966 | Glantz | 15/210.1 |
| 4,311,223 | A * | 1/1982 | Stein | 206/315.9 |
| 4,511,140 | A * | 4/1985 | Wenger | 473/59 |
| 5,484,329 | A * | 1/1996 | Engelbrektson | 451/523 |
| 5,613,896 | A * | 3/1997 | Haus et al. | 451/50 |
| 6,402,600 | B1 * | 6/2002 | Besch | 451/268 |
| 6,439,982 | B1 * | 8/2002 | Klukos | 451/307 |
| 7,585,203 | B1 * | 9/2009 | Shim | 451/5 |
| 7,892,073 | B1 * | 2/2011 | Smania et al. | 451/50 |
| 2006/0111029 | A1 * | 5/2006 | Sim | 451/491 |
| 2011/0177760 | A1 * | 7/2011 | Tanaka et al. | 451/50 |
| 2012/0058715 | A1 * | 3/2012 | Roze | 451/50 |

* cited by examiner

*Primary Examiner* — George Nguyen

(74) *Attorney, Agent, or Firm* — Harness, Dickey & Pierce, P.L.C.

(57) ABSTRACT

An apparatus (10) for altering a surface of a bowling ball (14) has a bowing ball holder (12) with a surface altering mechanism (16). The bowling ball holder (12) includes a portion (18) to receive the bowling ball (14). The surface altering mechanism (16) is positioned in the ball receiving portion (18) of the bowling ball holder (12). The surface altering mechanism (16) applies a surface pattern onto the bowing ball (14).

13 Claims, 3 Drawing Sheets

APPARATUS FOR ALTERING A SURFACE OF A BOWLING BALL

CROSS-REFERENCE TO RELATED APPLICATIONS

This application claims the benefit of U.S. Provisional Application No. 61/502,088, filed on Jun. 28, 2011. The entire disclosure of the above application is incorporated herein by reference.

FIELD

The present disclosure relates to bowling and, more particularly, to a method and apparatus for altering a surface of a bowling ball.

BACKGROUND

In bowling, the bowling ball travels down the lane to attack and knock down the pins. The lane on which the bowling ball travels includes a thin coating of oil. This oil has an effect on the ball as the ball rolls down the lane. If the bowling ball is smooth, the oil will build up along the ball as it is rolled down the lane. If the bowling ball includes a surface texture or scratch pattern, the oil will be dissipated along the grooves in the pattern so that the path of the ball is more predictable. Thus, the scratch pattern on the bowling ball acts like a tire thread going through water pushing the oil out of the way to enable the ball to track down the lane into the pins.

Thus, it is desirable to have a device that applies a consistent scratch or surface texture onto the bowling ball. The more consistent the scratch pattern, the better maneuverability of the bowling ball as it travels down the lane. Accordingly, the present disclosure provides the art with an apparatus that applies a consistent scratch or textured pattern onto a bowling ball surface. The present disclosure provides a method that enables the user to apply a consistent pattern onto his bowling ball with minimal effort. The present invention provides a fast, convenient and effective apparatus to apply the pattern onto the ball.

SUMMARY

According to a first aspect of the disclosure, an apparatus for altering a surface of a bowling ball comprises a bowling ball holder with a portion to receive a bowling ball. A surface altering mechanism is positioned in the receiving portion of the bowling ball holder. The surface altering mechanism provides a surface pattern onto the bowling ball surface. The bowling ball holder includes at least one, and preferably a pair, of handles. The bowling ball holder is made from a fabric material and includes one or more pockets to receive the surface altering mechanism. The fabric member includes a base panel and a pair of side panels. The surface altering mechanism is an abrasive pad having a desired grit value. The abrasive pad is removable from the bowling ball receiving portion of the bowling ball holder.

According to another aspect of the disclosure, an apparatus for altering a surface of a bowling ball comprises a fabric bag to receive a bowling ball. The fabric bag includes a receiving portion and at least one handle. A surface altering mechanism has a desired grit value. The surface altering mechanism is positioned in the ball bag receiving portion. The surface altering mechanism applies a scratch or surface pattern onto the bowling ball. The fabric bag includes pockets to receive the surface altering mechanism. The fabric bag includes a base panel and a pair of side panels. The surface altering mechanism is removable from the fabric bag. Alternatively, the surface altering mechanism can be held into the fabric bag by fasteners such as hook and loop, snap, button and removable adhesive or the like fasteners. A plurality of surface alternating mechanism, each with a different grit value, can be substituted for one another into the fabric bag.

According to a third aspect of the disclosure, a method for applying a scratch pattern onto a bowling ball comprises the steps of providing a surface altering mechanism positioned within a fabric bag. A bowling ball is positioned into the fabric bag. The fabric bag is lifted by at least one handle. The fabric bag is lifted and shaken so that the bowling ball rotates or moves in the fabric bag. The surface altering mechanism applies a scratch pattern onto the bowling ball. The bowling ball is removed from the bag and wiped for loose particles. Generally, the fabric bag is shaken and lifted by a pair of handles.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
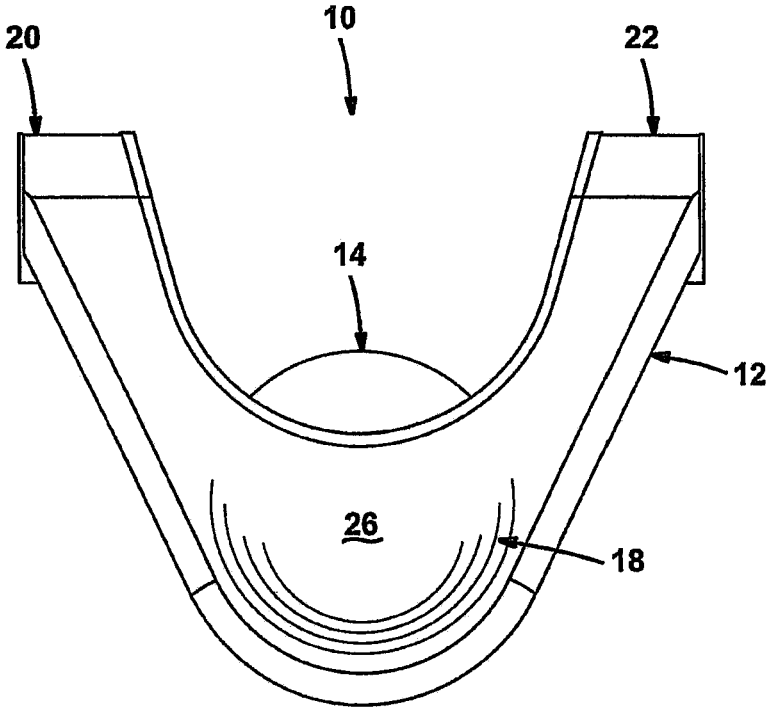
FIG. 1 is a front elevation view of an apparatus for altering a surface of a bowling ball including a bowling ball.

Turning to the figures, an apparatus for altering a surface of a bowling ball is illustrated and designated with the reference numeral 10. The apparatus 10 includes a bowling ball holder or bag 12. A bowling ball 14 is received within the holder 12. A surface altering mechanism 16 is positioned inside of the bowling ball holder 12 as illustrated in FIGS. 2 and 4-9.

The bowling ball bag 12 includes a ball receiving portion 18 and a pair of handles 20, 22. The bowling ball holder 12 includes a base panel 24 and a pair of side panels 26, 28. The base 24 and side panels 26, 28 are formed from a fabric material. The base and side panels 24, 26, 28 are generally sewed together with one another to provide the holder or bag 12. The base panel 24 connects with the tops of side panels 26, 28 to form the handles 20, 22. The side panels 26, 28 have an overall U-shape and are connected to one another at their ends to form the handles 20, 22. Generally, aperture 36, 38 are formed at the handles 20, 22 to enable access to the user.

Figure 2:
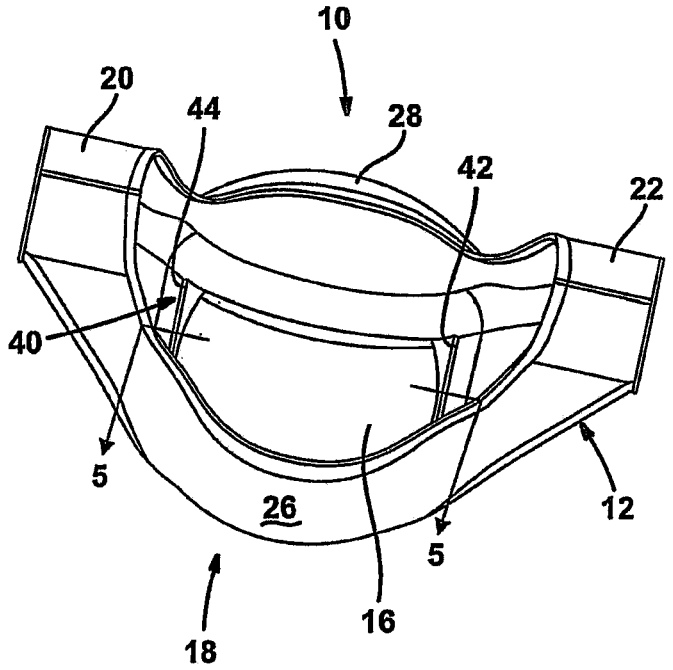
FIG. 2 is a perspective view of the apparatus of FIG. 1 with the bowling ball removed.
Figure 3:
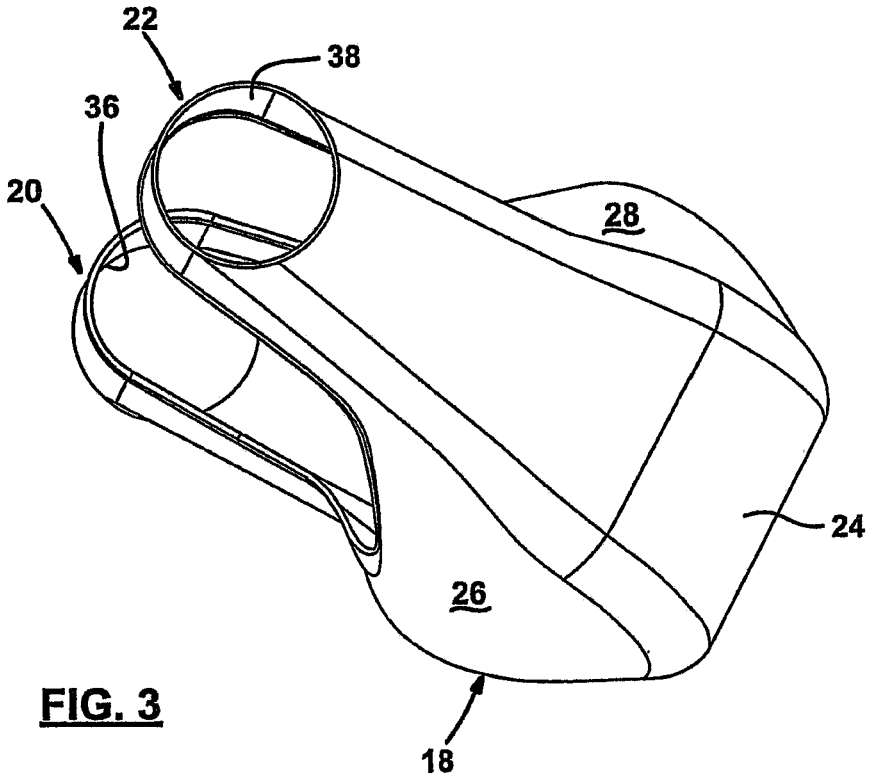
FIG. 3 is a side elevation view of the apparatus of FIG. 1.
Figure 4:
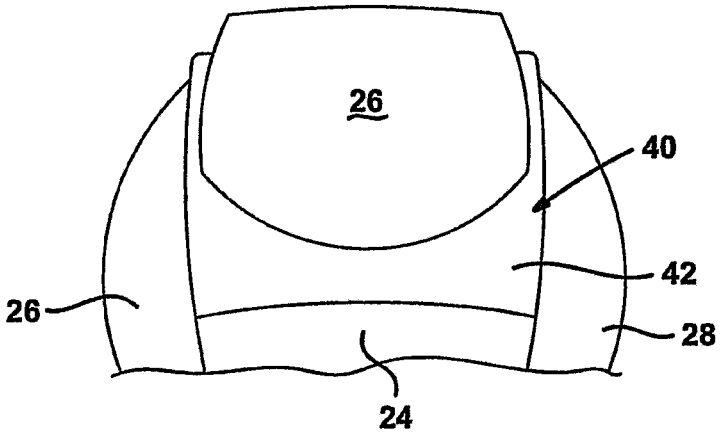
FIG. 4 is an elevation view of the apparatus turned inside out illustrating a pad fastening mechanism.
Figure 5:
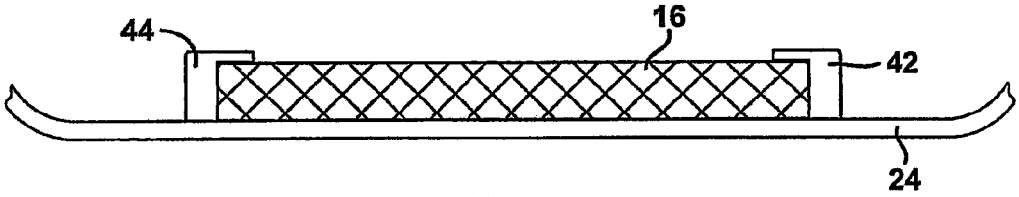
FIG. 5 is a cross-sectional view along line 5-5 of FIG. 2.

Looking at FIGS. 2 and 4, the surface altering mechanism 16 is received in a fastening mechanism 40. The fastening mechanism 40 includes pockets 42, 44 in the base panel 24. The pockets 42, 44 are formed into the base panel 24. The pockets 42, 44 enable the ends of the surface altering mechanism 16 to be slid into the pockets 42, 44 to retain and secure the surface altering mechanism 16 onto the base panel 24 of the bowling ball holder 12. The pockets 42, 44 can be secured to the base 24 by sewing adhesives or the like so that the pockets 42, 44 are able to receive the ends of the surface altering mechanism 16 as seen in FIGS. 4 and 5.

Ordinarily, the fabric material utilized to form the base 24 and side panels 26, 28 is an unformed draping cloth structure. However, the cloth could include a polymer component to enable the base and side walls 24, 26, 28 to have a formed type configuration that would correspond to and fit the bowling ball.

The surface altering mechanism 16 has an overall rectangular configuration with a desired thickness. Generally, the surface altering mechanism 16 is of a pad type design. The surface altering mechanism 16 is a nonwoven abrasive material. Generally, the abrasive material includes cut fiber strands coated with an abrasive resin. The surface altering mechanism 16 can have a desired grit value. Generally, the grit values range from 1,000 to 3,000 depending upon the desired design. Generally, a 1,500 grit and a 2,500 grit pad have been found to provide satisfactory results. Thus, any number of grit pads, with different grit values, can be substituted into the bowling ball holder 12 to provide a different surface pattern onto the bowling ball 14.

Figure 6:
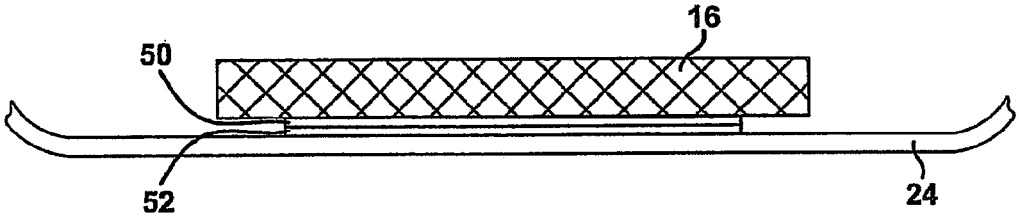
FIG. 6 is cross sectional view like FIG. 5 of another embodiment of the pad fastening mechanism.

Turning to FIGS. 6-9, alternative fasteners 40 to retain the surface altering mechanism 16 onto the base panel 24 are illustrated. FIG. 6 illustrates the surface altering mechanism 16 utilizing a hook 50 and loop 52 mechanism. One of the hook 50 or loop 52 mechanism is secured to the surface altering mechanism 16 and the other is secured to the base panel 24 of the ball holder 12. It may be possible to use just a hook mechanism secured onto the base panel 24 if the surface altering mechanism 16 is capable of acting as the loop mechanism.

Figure 7:
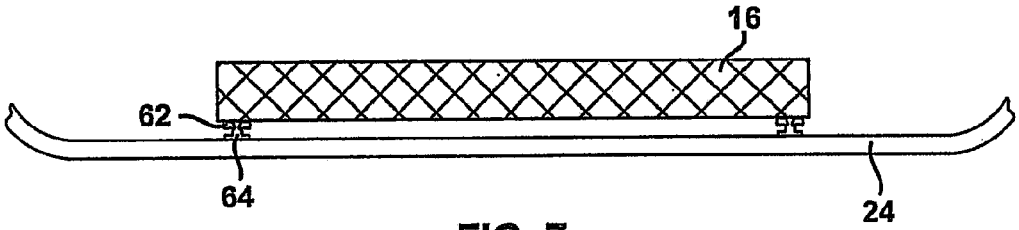
FIG. 7 is a view like FIG. 5 of another embodiment of a pad fastening mechanism.

FIG. 7 illustrates the use of a snap 60 fastener. The snap 60 has a receiving member 62 and a projecting member 64. These snap members 62, 64 can be secured with the surface altering mechanism 16 and the base panel 24 of the ball holder 10 as shown.

Figure 8:
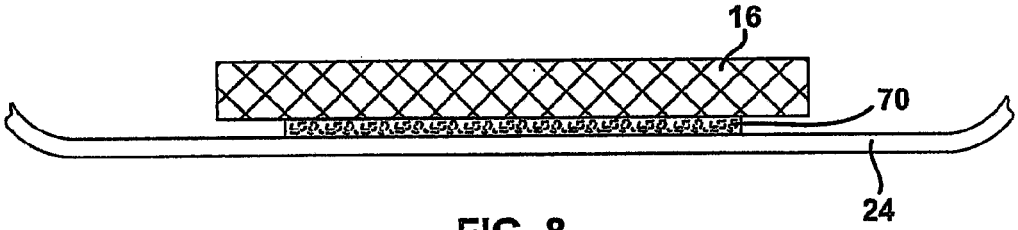
FIG. 8 is a view like FIG. 5 of an additional embodiment of a pad fastening mechanism.

FIG. 8 illustrates a surface altering mechanism 16 with a releasable adhesive mechanism 70, such as two sided tape, secured between the surface altering mechanism 16 and the base panel 24 of the bowling ball holder 12.

Figure 9:
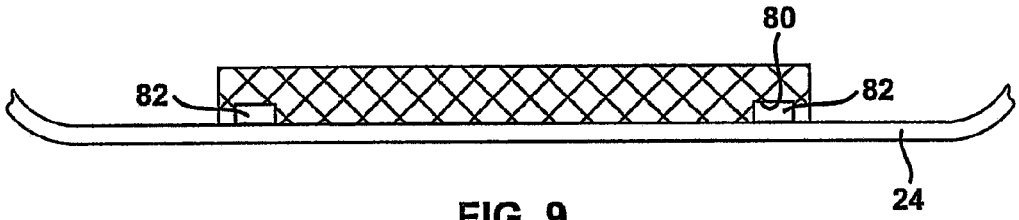
FIG. 9 is a view like FIG. 5 of an additional embodiment of a pad fastening mechanism.

FIG. 9 illustrates the surface altering mechanism 16 with cut-outs 80 to receive buttons 82 secured with the base 24 of the ball holder 12.

Thus, various types of fasteners may be utilized to position the surface altering mechanism 16 onto the base 24 of the bowling ball holder or bag 12. Additionally, it may be possible to position the surface altering mechanism 16 on the base panel 24 without a fastening mechanism. The surface altering mechanism 16 may be sized to fit between the side panels 26, 28 on the base panel 24 so that a fastening mechanism is not required.

A method of using the bowling ball holder 12 is as follows. A bowling ball holder 12, as described above, provided with a surface altering mechanism 16, is provided to the user. The user positions a bowling ball 14 inside of the bowling ball holder or bag 12. The bag 12 is lifted by the pair of handles 20, 22. The user lifts and shakes the bowling ball holder 12, via the handles 20, 22, so that the bowling ball 14 rotates or moves inside the bowling ball holder 12. As this occurs, the surface altering mechanism 16 applies a textured or scratch pattern onto the bowling ball 14. Thus, as the bowling ball 14 is rotated in the holder 12, a consistent pattern with a more uniform finish is applied onto the bowling ball 14. After the bowling ball 14 has been provided with the scratch pattern, it is removed from the holder 12. The bowling ball 14 is wiped off so that any loose dust or particles are removed from the bowling ball 14.

The description of the disclosure is merely exemplary in nature and thus, variations that do not depart from the gist of the disclosure are intended to be within the scope of the disclosure. Such variations are not to be regarded as a departure from the spirit and scope of the disclosure.

What is claimed is:

1. An apparatus for altering a surface of a bowling ball comprising:

a bowling ball holder having a fabric member with a base and a pair of sides to receive a bowling ball; and a surface altering mechanism fastened with the base of the bowling ball holder, the surface altering mechanism providing a surface pattern on the bowling ball.

2. The apparatus of claim 1, further comprising at least one handle on the bowling ball holder.

3. The apparatus of claim 1, wherein the fabric member includes a fastening mechanism for receiving the surface altering mechanism.

4. The apparatus of claim 1, wherein the surface altering mechanism is an abrasive pad having a desired grit value.

5. The apparatus of claim 1, wherein the surface altering mechanism is removable from the bowling ball holder base.

6. An apparatus for altering a surface of a bowling ball comprising:

a fabric bag for receiving a bowling ball, the fabric bag including a receiving portion and at least one handle and a fastening mechanism that includes pockets for receiving a surface altering mechanism; and the surface altering mechanism having a desired grit value, the surface altering mechanism positioned in the bag receiving portion, the surface altering mechanism providing a scratch pattern onto the bowling ball.

7. The apparatus of claim 6, wherein the fabric member includes a base and a pair of sides with the surface altering mechanism fastened with the base.

8. The apparatus of claim 6, wherein the surface altering mechanism is removable from the fabric bag.

9. The apparatus of claim 6, wherein a fastening mechanism such as a hook and loop, snap, button, removable adhesive or the like fastener secures the surface altering mechanism with the fabric bag.

10. The apparatus of claim 6, wherein a plurality of surface altering mechanisms, each with a different grit value, can be substituted for one another into the fabric bag.

11. A method for applying a scratch pattern onto a bowling ball comprising the steps of:

providing a fabric bag including a receiving portion and at least one handle and a surface altering mechanism positioned in the bag receiving portion;

positioning a bowling ball in the fabric bag;

lifting the fabric bag by the at least one handle;

lifting and shaking the fabric bag so that the bowling ball rotates or moves in the fabric bag; and applying a scratch pattern onto the bowling ball.

12. The method of claim 11, further comprising removing the bowling ball from the bag and wiping loose particles from the bowling ball.

13. The method of claim 11, wherein the bags has two handles and lifting and shaking the bag holding both handles.

* * * * *

UNITED STATES PATENT AND TRADEMARK OFFICE

CERTIFICATE OF CORRECTION

PATENT NO. : 8,932,111 B2
APPLICATION NO. : 13/531913
DATED : January 13, 2015
INVENTOR(S) : Lori Tessmar et al.

It is certified that error appears in the above-identified patent and that said Letters Patent is hereby corrected as shown below:

In the title page item (57) ABSTRACT,
Line 2, “bowing” should be --bowling--.
Line 7, “bowing” should be --bowling--.

In the Specification,

Column 1,
Line 52, “pair,” should be --pair--.

Column 3,
Line 45, “ball holder 10” should be --ball holder 12--.

Signed and Sealed this
Eighth Day of September, 2015

Michelle K. Lee

Michelle K. Lee
*Director of the United States Patent and Trademark Office*